United States Patent [19]

Baggio

[11] 4,433,456

[45] Feb. 28, 1984

[54] CLOSURE DEVICE PARTICULARLY FOR SKI BOOTS

[75] Inventor: Giorgio Baggio, S. Martino di Lupari, Italy

[73] Assignee: Nordica S.p.A., Montebelluna, Italy

[21] Appl. No.: 340,549

[22] Filed: Jan. 18, 1982

[30] Foreign Application Priority Data

Jan. 28, 1981 [IT] Italy ..... 19383 A/81

[51] Int. Cl.[3] ..... A43C 11/00

[52] U.S. Cl. ..... 24/68 SK; 24/68 B; 24/71.1; 36/50

[58] Field of Search ..... 24/68 SK, 68 B, 69 J, 24/69 SK, 70 R, 70 SK, 70 CT, 70 TT, 70 ST, 70 J, 71 SK, 71.1, 72.2, 269, 281; 36/50

[56] References Cited

U.S. PATENT DOCUMENTS

| | | | |
|---|---|---|---|
| 2,607,560 | 8/1952 | Bugg | 24/71.2 |
| 2,989,820 | 6/1961 | Leclerc | 46/192 |
| 3,214,809 | 11/1965 | Edwards | 24/68 B |
| 3,262,167 | 7/1966 | Martin | 24/68 SK |
| 3,729,779 | 5/1973 | Porth | 24/68 SK |
| 3,738,027 | 6/1973 | Schoch | 36/50 |
| 3,808,644 | 5/1974 | Schoch | 24/68 SK |
| 3,834,048 | 9/1974 | Maurer | 24/68 SK |
| 4,057,220 | 11/1977 | Kudlacek | 242/99 |
| 4,261,081 | 4/1981 | Lott | 24/71.2 |

FOREIGN PATENT DOCUMENTS

| | | | |
|---|---|---|---|
| 2900077 | 7/1980 | Fed. Rep. of Germany | 36/50 |

*Primary Examiner*—Robert P. Swiatek
*Assistant Examiner*—David I. Tarnoff
*Attorney, Agent, or Firm*—Guido Modiano; Albert Josif

[57] ABSTRACT

The closure device comprises a box-like body associated with one of the ski boot flaps to be brought together and provided with a knob for actuating a spool whereon at least one small cable associated with the other of the flaps to be brought together is wound. Also provided is a ratchet gear mechanism driven by the knob to lock the spool at any selected position as the knob is turned in one direction, and to release the spool as the knob is rotated in the opposite direction.

6 Claims, 6 Drawing Figures

CLOSURE DEVICE PARTICULARLY FOR SKI BOOTS

BACKGROUND OF THE INVENTION

This invention relates to a closure device particularly for ski boots.

It is a well known fact that closure or latching devices currently mounted on ski boots generally comprise a number of hooks, which may have a variety of configurations and operate in practice on the lever principle.

This type of closure, even though universally accepted, is in may cases difficult to use by the skier, especially in the light of the environment wherein such hooks or latches are to be operated, and moreover, fails to provide a quick, easy and accurate adjustement capability of the clamping force which it is desired to apply.

According to other approaches, closure is effected by actuating a Maltese cross mechanism, which has, however, the disadvantage of a rather high pitch, which results in the impossibility of achieving a fine adjustment of the closure.

Another drawback to be attributed to this type of mechanism is that it has been ascertained experimentally that vibrations or other incidental factors tend to release the closure, so that the latter is actually unreliable.

SUMMARY OF THE INVENTION

Thus the task of the invention is that of eliminating such prior drawbacks by providing a closure device, specially designed for use on ski boots, which in addition to affording the possibility of achieving the closed or latched state in a quick manner, also enables a very accurate adjustment of the closing effort to be exerted.

Within this task it is an object of the invention to provide a device which can be easily operated even with gloves on one's hands, without requiring any special effort by the user.

A further object of the invention is to provide a device, which while being perfectly lockable in any desired position, is also readily releasable when the closure device is to be opened.

Yet another object of the invention is to provide a closure device which is highly reliable in use, and which can ensure the utmost accuracy in operation.

According to one aspect of the present invention, the aforesaid task and objects as well as yet other objects, such as will be apparent hereinafter, are achieved by a closure device particularly for ski boots, characterized in that it comprises a box-like body associated with one of the ski boot flaps to be brought together and provided with a knob for the actuation of a spool whereon at least one small cable length associated with the other of said flaps to be brought together can be wound, there being further provided ratchet gear means operable through said knob and effective to lock said spool in any desired position, as said knob is rotated in one direction, and to release said spool as said knob is rotated in the opposite direction.

BRIEF DESCRIPTION OF THE DRAWINGS

Further features and advantages will be more clearly understood from the following description of a preferred, but not limitative, embodiment of a closure device particularly for ski boots, with reference to the accompanying illustrative drawings, given herein by way of example only, and where.

DESCRIPTION OF THE PREFERRED EMBODIMENTS

Figures 1, 2:
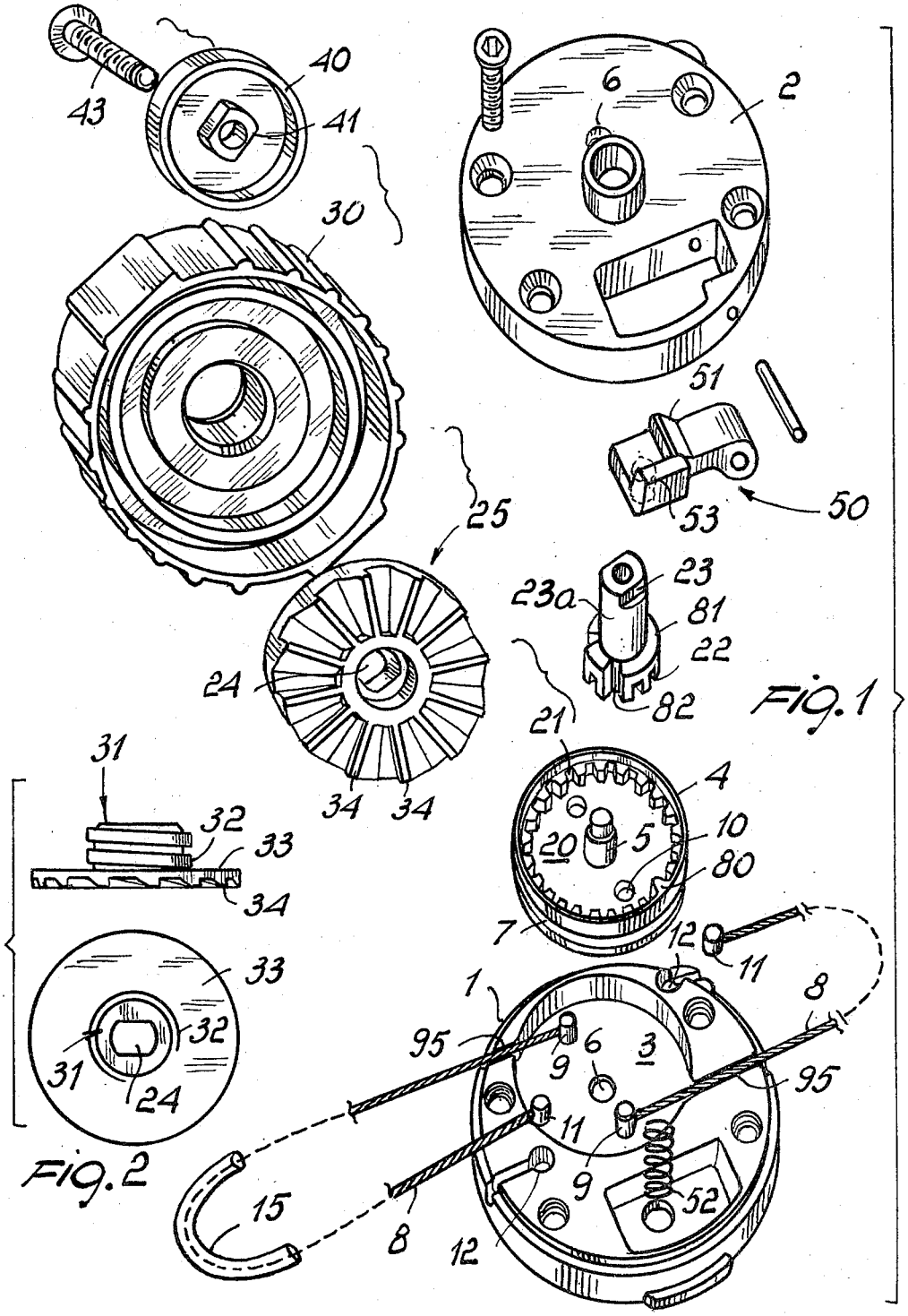
FIG. 1 is an exploded perspective view of the device in diagramatic form.
FIG. 2 shows, in elevation and plan view respectively, a ring nut arranged to cooperate with the ratchet gear means.
Figure 4:
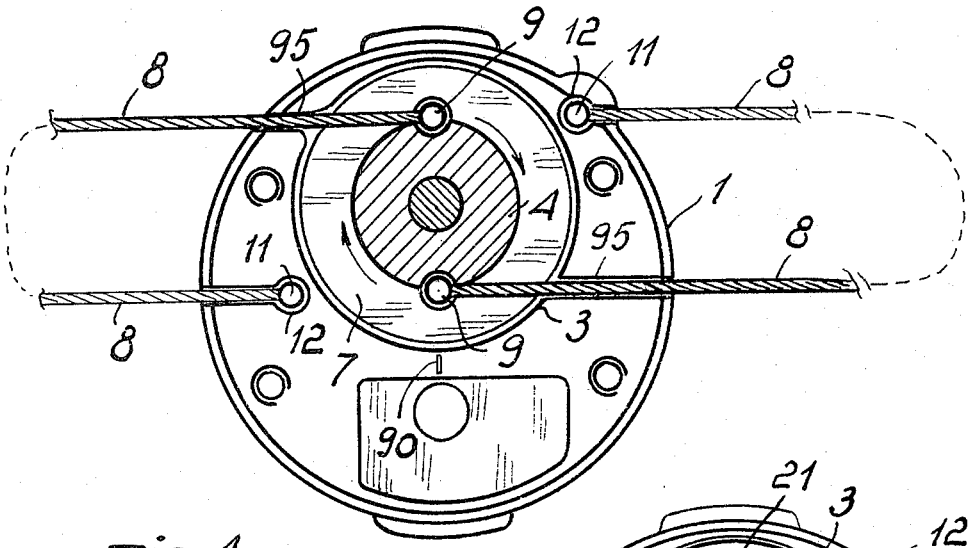
FIG. 4 is a schematical sectional view taken along the line IV—IV of FIG. 3.
Figure 5:
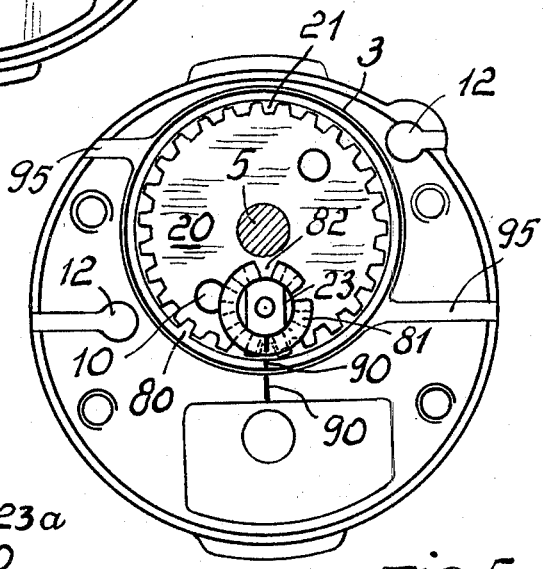
FIG. 5 shows schematically a sectional view taken along the line V—V of FIG. 3.
Figure 3:
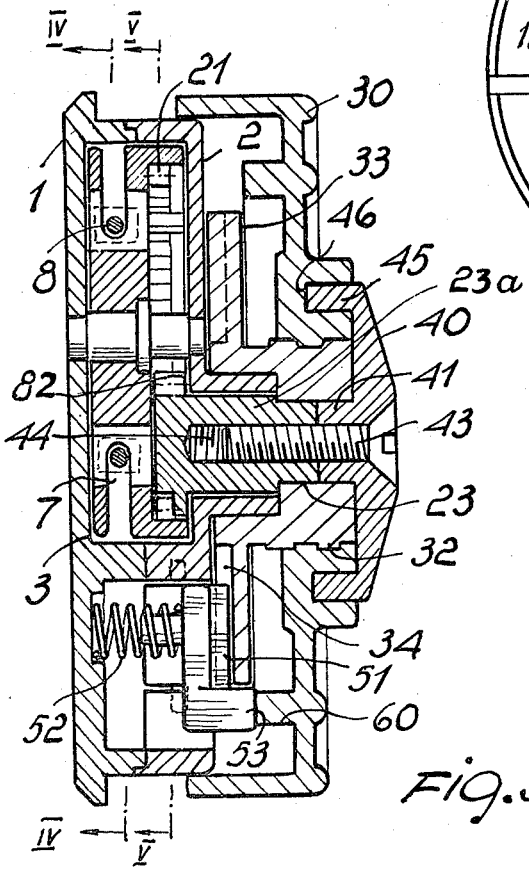
FIG. 3 is a cross-sectional view of this device.

With reference to the drawing figures, the closure device particularly for ski boots, according to the invention, comprises a box-like body, which includes a lower half-shell 1, associable with one of the ski boot flaps to be brought together, and an upper half-shell 2, adapted for engagement with the lower half-shell 1 and attachable thereto by means of screws or similar fastening means.

The cylindrical box-like body as outlined above defines on its interior a cylindrical cavity 3, wherein a spool 4 is accommodated rotatably and eccentrically, said spool having a pivot pin 5 which is carried at its ends in holes 6, respectively defined in the lower half-shell 1 and upper half-shell 2.

On said spool 4, there is defined a groove 7 for winding a pair of small cable lengths 8 thereon, which have ends associated with diametrically located points on the spool 4.

More specifically, each small cable length 8 is provided at one end with an enlarged portion 9 adapted for insertion into seats 10 defined on the spool 4 to thus secure the cable end to the spool.

The other ends of the small cables 8 are provided, in this embodiment of the invention, with an enlarged body 11 which can be inserted into an engagement seat 12 defined by the half-shells 1 and 2, thereby the small cable lengths 8 have in practice a closed loop configuration.

The cables are run through the interior of a tubular elbow 15 which is associated outside of the box-like body with, or in any way secured to, the other of the boot flaps to be brought together, so that, by winding the cable 8 onto the spool 4, the tubular elbows 15 are brought together to produce the closure sought.

The provision of two small cable lengths 8 in a closed loop configuration is only dictated by manufacturing convenience considerations, since it would also be possible in theory to utilize but one cable to bring the flaps together, and to secure, for example, the ends of the cable respectively to the spool and to the other flap to be united without requiring the provision of the cable deflecting tubular elbows.

The spool 4 has a recess 20 defined by a peripheral rim of the spool which has an inside serration 21 in mesh engagement with a small pinion gear 22, which can be rotated by a knob 30 located externally to the cited box-like body and coaxially with the pionion 22.

More specifically, the pinion 22 is defined on a shank-like member 23*a* having a bevelled shank portion 23 which can be inserted into a shaped hole 24 correspondingly defined on the interior of a ring nut 25.

The ring nut 25 defines a ratchet member or body 31, having a sleeve portion defining internally said hole 24, which is provided with a long pitch external left-handed quick-thread formation 32 and is integral, with a flange 33 having a ratchet serration 34 on its bottom face facing the half-shells 1 and 2 outside thereof.

The knob 30 is connected to the ring nut 25 coaxially therewith, and more precisely has a threading matching said quick-thread formation 32. Also provided is a covering cap 40 having a projecion 41 the configuration whereof matches the hole 24 and which can be inserted axially through the hole 24 to abut against the end of the shank member 23*a;* the cap 40 is secured to the shank member 23*a* by means of a screw 43 which engages in a female thread formation 44 defined axially in the shank 23*a*. As visible in the drawings, the ratchet member 31 is held by the cap 40 and shank 23*a* with pinion 22 axially undisplaceable with respect to the spool 4, but is rotatively connected therewith. The shank member 23*a* is thus rigid with the sleeve portion of ratchet member 31 and with the ratchet serration 34. The cap 40 has a peripheral border 45 which is inserted into a ring-like seat 46 defined on the outer face of the knob 30.

The ratchet means comprising ratchet member 31 also comprise a pawl 50 hinged to the upper half-shell 2 in an opening thereof for pivotal movement about an axis extending in a perpendicular plane to the axis of the ring nut 25. The pawl 50 has at the top an engagement tooth 51 adapted for selective releasable engagement with the serration 34, thereby it behaves as a pawl element as the ring nut 25 is rotated in one direction, and as a locking element as the ring nut 25 is rotated in the opposite direction.

Said pawl 50 is urged against the serration 34 by a spring 52 acting on the inner bottom of the half-shell 1 and has, on the same side as the tooth 51, a shoulder 53 adapted to engage by contact an actuation border or projection 60 defined on the inner face of the knob 30. As visible from the drawings, the knob 30 has a cup-like shape receiving and concealing the ratchet serration 34 and the pawl 50.

Figure 6:
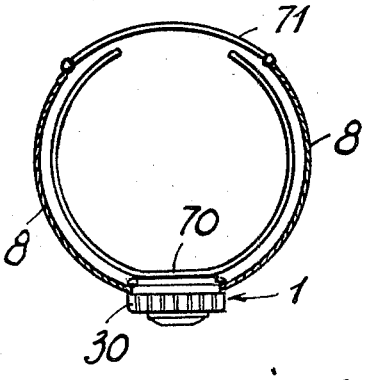
FIG. 6 is a diagram showing a possible application of this closure device to the cuff portion of a boot.

The closure device as shown diagramatically in FIG. 6 can be mounted by attaching the box-like body to the rear portion 70 of the boot cuff and connecting the cables 8, and more specifically the tubular elbow 15, to the edges of the front portion 71 of the cuff.

To produce the closed state of the device, the knob 30 is turned clockwise. Through the coupling system just described, owing to the provision of the left-handed thread formation 32, the knob will first rotate relatively to the ring nut 25 until it abuts against the cap 40. At this stage, the knob will become rigid with the ratchet member 31, and with the pinion 22 which, by meshing with the inside serration 21, causes the spool 4 to rotate and wind the cables 8 around its ring-like groove 7, which results in the boot flaps being brought together. During this rotation step, the actuation projection 60 provided on the inner face of the knob 30 practically does not engage with the shoulder 53 of the pawl 50, so that the pawl is positioned with its tooth 51 elastically urged against the serration 34 and the ring nut 25 is only allowed to rotate in the winding direction since the sloping flanks of the teeth 51 and serration 34 behave in practice as a ratchet element. Rotation in the opposite direction instead prevented in that the front portions of the teeth abut together, thereby the pawl 50 practically meshes with the serration 34.

As the clockwise rotation of the knob is continued, the desired tightening action of the closure device is achieved in a very accurate manner, thus providing a fine form of adjustment.

By turning the knob 30 in the opposite direction, that is counterclockwise, the knob, owing to the presence of the left-handed thread formation 32, practically unthreads itself onto the ring nut 25 and moves closer to the flange 33.

With this translation of the knob relatively to the ring nut, it occurs that the projection 60 acts onto the shoulder 53, thus urging the pawl 50 against the bias of the spring 52 in a direction parallel to the axis of the sleeve portion and disengaging the engagement tooth 51 from the serration 34.

As the pawl 50 is disengaged from the ring nut 25, and the knob 30 abuts against the flange 33, the ring nut 25 is enabled to freely rotate in a counterclockwise direction together with the knob 30 and spool 4 which is connected thereto by the pinion 22 meshing with the inside serration 21, so that the cables 8 will unwind from the spool 4 and enable the boot flaps to be moved away from each other in the opening direction.

In order to prevent, after the cables 8 have been fully unwound from the spool 4, the rotational movement from being continued beyond a completely unwound condition such as to wind the cables in the opposite direction onto the spool, limiter means is provided in the form of an axially protruding tooth 80 in the serration 21, which will engage with a small collar 81 defined on the shank-like member 23*a* at the root of the teeth on the pinion 22 such as to inhibit rotation. As visible from the drawings, the teeth of the pinion 22 are provided on the collar 81 in form of a frontal toothing.

By contrast, to enable rotation in the cable winding direction, on the collar 81 there are provided peripheral cutouts, indicated at 82, which are angularly so positioned as to match with the protruding tooth 80 during the cable winding step onto the spool 4 away from the completely unwound position of the spool 4.

The cutouts 82 are in fact provided with such a pitch as to be located at the protruding tooth 80 after the spool has completed one revolution about its own axis in the clockwise direction only.

To enable an accurate positioning during the assembling operation, markings 90 are provided on the lower half-shell 1, on the serration 21 and pinion 22, which markings must be aligned together during the device assembling operation.

It should be further added that, on the lower half-shell 1, guiding troughs 95 are provided which enable the cables 8 to be inserted onto the spool 4 in a practically tangent direction, so as not to create stress on the cables.

It will be appreciated from the foregoing that the invention fully achieves its objects, and in particular that the device allows the conversion of a rotary motion, as imparted to the knob 30, into a translatory motion of the cables 8. By way of illustration only, it is to be pointed out that with a prototype actually built it is possible to obtain a travel distance of about 160 mm for the cables, with a fine adjustment pitch of about 2 mm; that is, in practice, the mechanism can be locked automatically at any desired position, thus enabling an extremely fine adjustment capability.

Another advantage of the invention is that to operate the device, the user is only required to manipulate the knob 30, which having a considerable size, can be readily and easily manipulated by the user.

The invention as described in the foregoing is susceptible to many modifications and variations, without departing from the scope of the instant inventive concept.

Furthermore, all of the details may be replaced with other technically equivalent elements.

In practicing the invention, the materials employed, as well as the dimensions and contingent shapes may be any suitable ones for the intended applications.

I claim:

1. A closure device particularly for ski boots, comprising a box-like body fixable to a boot portion, a spool rotatably arranged within said box-like body, at least one cable having one end secured to said spool for being wound thereon and unwound therefrom, said at least one cable engaging another boot portion outwardly of said box-like body for selectively tightening and loosening said another boot portion with respect to said boot portion, a knob externally of said box-like body and rotatable with respect thereto for operation of said spool, ratchet means for locking said spool upon rotation of said knob in one direction and releasing said spool upon rotation of said knob in an opposite direction, said ratchet means comprising a ratchet member having a ratchet serration and a sleeve portion rigid therewith and coaxial with said knob, and a pawl selectively engageable with, and disengageable from, said ratchet serration, wherein said ratchet member is axially undisplaceable with respect to said spool but rotatively connected therewith and has a thread formation on said sleeve portion, and wherein said knob has a threading matching with said thread formation on said sleeve portion and a projection for operation of said pawl, said knob being threadable on said sleeve portion into a position rigid with said ratchet member for rotation of said spool in a cable winding direction, and unthreadable on said sleeve portion into a position in which said projection disengages said pawl from said ratchet serration and said knob is rigid with said ratchet member for rotation of said knob in said opposite direction to cause unwinding of said at least one cable from said spool.

2. A closure device as claimed in claim 1, wherein said ratchet serration is formed on a face of a flange integral with said sleeve portion, and wherein said pawl is displaceable by said projection of said knob in a direction extending parallel to the axis of said sleeve portion and said knob.

3. A closure device as claimed in claim 2, wherein a cap member is fixed to said sleeve portion opposite to said flange and said flange and said cap member define abutments for said knob.

4. A closure device as claimed in claim 1, wherein said box-like body comprises two half shells defining a cylindrical box-like body, and wherein said spool is arranged eccentrically within said cylindrical box-like body, said ratchet serration and said sleeve portion being arranged outside of said cylindrical box-like body coaxially thereto and said pawl being arranged in an opening of said cylindrical box-like body and resiliently urged against said ratchet serration, said knob having a cup-like shape receiving and concealing said ratchet serration and said pawl.

5. A closure device as claimed in claim 4, wherein said spool has a peripheral rim integral therewith, said peripheral rim having an inside serration, and wherein a pinion rigid with said sleeve portion and said ratchet serration meshes with said inside serration, said pinion being coaxial with said knob.

6. A closure device as claimed in claim 5, wherein said pinion is defined on a shank-like member rigid with said sleeve portion and said ratchet serration, said shank-like member having a collar and a frontal toothing on said collar for engagement with said inside serration, said inside serration having a protruding tooth for engagement with said collar to stop rotation of said inside serration and said spool beyond a completely unwound condition, and said collar having peripheral cutouts arranged at angular positions of said collar such as to match with said protruding tooth for allowing rotation of said inside serration and said spool in positions away from the completely unwound condition of said spool.

* * * * *